United States Patent [19]

Bank

[11] Patent Number: 4,472,440

[45] Date of Patent: Sep. 18, 1984

[54] PACKAGE CONTAINING A MOISTURE RESISTANT EDIBLE BAKED CONTAINER

[75] Inventor: Herbert M. Bank, Owings Mills, Md.

[73] Assignee: Maryland Cup Corporation, Owings Mills, Md.

[21] Appl. No.: 521,405

[22] Filed: Aug. 8, 1983

Related U.S. Application Data

[63] Continuation of Ser. No. 347,097, Feb. 9, 1982, abandoned.

[51] Int. Cl.[3] ..... A21D 13/00; B65D 81/02; B65D 85/36

[52] U.S. Cl. ..... 426/128; 426/94; 426/106; 426/118; 426/76; 426/138; 220/306; 220/366

[58] Field of Search ..... 426/128, 118, 138, 90, 426/94, 95, 130, 391, 106, 76; 220/366, 306

[56] References Cited

U.S. PATENT DOCUMENTS

| | | | |
|---|---|---|---|
| 178,622 | 6/1876 | Ford | 220/306 |
| 1,470,763 | 10/1923 | Richards | 426/128 |
| 1,509,194 | 9/1924 | Dresser | 426/76 |
| 1,558,922 | 10/1925 | Reilly | 426/139 |
| 1,615,680 | 1/1927 | Buhse | 426/139 |
| 1,848,120 | 3/1932 | Fisher | 426/128 |
| 1,878,395 | 9/1932 | Hamwi | 426/138 |
| 2,111,021 | 3/1938 | Bemis | 426/138 |
| 2,167,353 | 7/1939 | Frediani | 426/95 |
| 2,462,497 | 2/1949 | Heyman | 426/139 |
| 2,759,826 | 8/1956 | Lindsey | 426/95 |
| 2,852,390 | 9/1958 | Hatcher | 426/138 |
| 3,070,275 | 12/1962 | Bostrom | 426/124 |
| 3,137,431 | 6/1964 | Crouse et al. | 229/1.5 B |
| 3,170,568 | 2/1965 | Carter | 426/130 |
| 3,261,530 | 7/1966 | Cave | 426/106 |
| 3,326,408 | 6/1967 | Ringlen | 426/106 |
| 3,331,691 | 7/1967 | Lindsey | 426/95 |
| 3,339,786 | 9/1967 | Biglin | 220/366 |
| 3,353,708 | 11/1967 | Davis | 220/306 |
| 3,366,486 | 1/1968 | Weinstein et al. | 426/138 |
| 3,498,495 | 3/1970 | Davis | 220/306 |
| 3,561,668 | 2/1971 | Bergstrom | 426/396 |
| 3,620,403 | 11/1971 | Rump | 206/551 |
| 3,637,404 | 1/1972 | Macmanus | 426/128 |
| 3,737,068 | 6/1973 | Bird | 220/306 |
| 3,794,090 | 2/1974 | Commisso | 426/118 |
| 3,797,694 | 3/1974 | See | 426/118 |
| 3,883,036 | 5/1975 | Mahaffy et al. | 220/306 |
| 3,912,118 | 10/1975 | Bird | 220/306 |
| 4,197,940 | 4/1980 | Derosset | 426/128 |
| 4,205,091 | 5/1980 | Van Horne | 426/144 |
| 4,206,854 | 6/1980 | Takami | 220/366 |
| 4,226,355 | 10/1980 | Helfrich | 426/139 |

FOREIGN PATENT DOCUMENTS

| | | | |
|---|---|---|---|
| 2261465 | 7/1973 | Fed. Rep. of Germany | 426/130 |
| 327322 | 4/1930 | United Kingdom | 426/138 |
| 347886 | 5/1931 | United Kingdom | 426/139 |

*Primary Examiner*—Steven L. Weinstein
*Attorney, Agent, or Firm*—McDougall, Hersh & Scott

[57] ABSTRACT

A merchandising package for prolonging holding and serving periods for food products served in edible baked containers is provided in which an edible baked container is provided with an internal moisture barrier and nested snugly in a conformally shaped external container which is of a substantially moisture impervious material. The external container has a top curl (rim) portion on which is snap-fitted the seating skirt of a domed clear plastic lid which protects the food product while permitting it to be viewed.

9 Claims, 4 Drawing Figures

PACKAGE CONTAINING A MOISTURE RESISTANT EDIBLE BAKED CONTAINER

This application is a continuation of copending application Ser. No. 347,097, filed on Feb. 9, 1982, now abandoned.

FIELD OF THE INVENTION

This invention relates to edible baked food containers and a merchandising packaging configuration for merchandising foodstuffs therein.

BACKGROUND OF THE INVENTION

In the retailing of food such as in restaurants and cafeterias, there is a need for providing both sanitary packaging for baked edible food containers such as pastry shells and the like as well as providing for maintaining such products, particularly when filled with cold foods such as vanilla pudding etc. for sufficient periods of time to hold the food in a desirable state over serving periods such as during luch and dinner times in commercial establishments.

It is therefore an object of the present invention to provide a new and novel mechandising package configuration including a baked edible food container therein.

Another object of the present invention is to provide a new and novel merchandising package for baked edible containers including moisture resistant coatings in the baked edible container.

Still another object of the present invention is to provide a new and novel merchandising package for foodstuffs contained in baked edible containers comprising a paper dish closely conforming to the size and shape of the baked edible container and including a domed clear plastic lid covering both the edible container and the contents thereof.

Yet another object of the present invention is to provide a new and novel merchandizing package for baked edible containers and the contents thereof which may be maintained in a chilled condition while preserving the integrity of the foodstuff and the baked edible container against moisture over a reasonable holding and serving period.

These and other objects of the present invention will become more fully apparent with reference to the following specification and drawings which relate to a preferred embodiment of the present invention.

SUMMARY OF THE INVENTION

A merchandising package of the present invention is comprised of an edible baked food container in the shape of a small dish, cup or the like, fabricated from a suitable batter which is fitted snugly inside a paper dish having a snap on clear plastic domed lid affixed to the top curl of the paper dish.

The paper dish utilized in the present invention is contemplated as being a conventional frusto-conical food container, such as a conventional cottage-cheese tub, disposable ice-cream sundae dish, or the like, having a closed bottom and a frusto-conical sidewall open at the top, with the top thereof defined by a curled rim portion of a configuration suitable for cooperating with a snap-on rim on the domed lid structure to provide an integral package.

The baked edible container and the paper dish or food tub are configured to closely conform one to the other and, in a preferred embodiment, the paper food container has a polyethylene layer on the interior thereof to provide enhanced moisture resistant properties to the package. Further, in a preferred embodiment of the present invention, there is a coating applied to the interior of the baked edible food container so as to provide a moisture barrier between that edible container and any food product placed therein.

The contents of the edible container may be cold puddings such as vanilla and chocolate pudding and the like which would cause the baked edible container to become soft or mushy after a relatively short time in the absense of a moisture resistant coating. The paper dish, with its moisture resistant liner, further provides for sitting the entire merchandising package in a bed of crused ice or the like to provide a chilled serving mode for the cold food product within the container while precluding moisture damage thereto.

In operation, the food package of the present invention is assembled by placing the baked edible food container within the paper tub, filling the baked edible container with food product and then placing the domed clear plastic lid snugly onto the top curl of the paper tub. This provides a merchandising package in which the food product is visible and which is sufficiently resistant to moisture to permit food products to be prepackaged for substantial holding and serving periods, such as, for example, holding and serving periods on the order of six (6) hours. This provides for more efficiency of food service in commercial establishments and reduces waste of food product caused by moisture absorption.

DETAILED DESCRIPTION OF THE DRAWINGS

Figure 1:
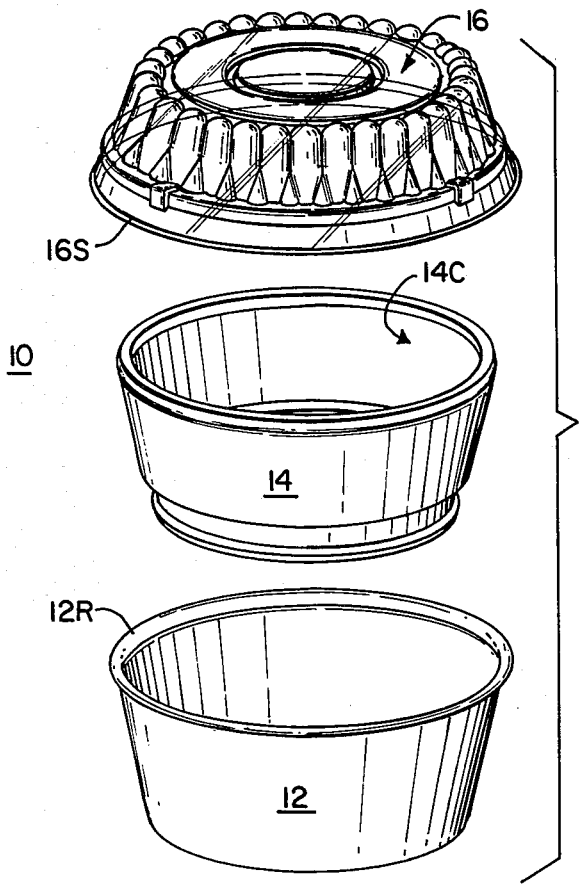
FIG. 1 is an exploded view of a food package of the present invention.

Referring in detail to the drawings and with initial reference to FIG. 1, the package 10 of the present invention is shown as including, as its components, a paper food tub 12, an edible internally coated food container 14 substantially conformally shaped to nest within the tub 12 and a transparent domed lid structure 16 which is configured to snap over the rim portion 12R of the food tub 12 by means of suitable camming surfaces in a dependent skirt portion 16S which snap over and engage the rim 12R of the paper food cup 12. The interior of the edible food container 14 presents a coated internal surface 14C to any food contained therein while the container 14 itself is comprised of a batter baked in a mold in the preferred embodiment of the present invention. The coating 14C is a moisture resistant coating which is also of a proper edible character to preclude the absorption of moisture by the baked batter in the container 14 from food placed therein.

Figure 2:
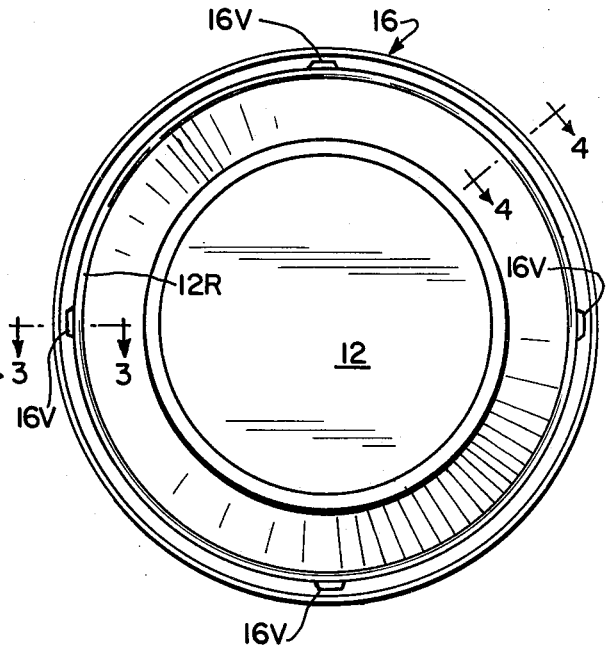
FIG. 2 is a bottom view of an assembled food package of the present invention.
Figure 3:
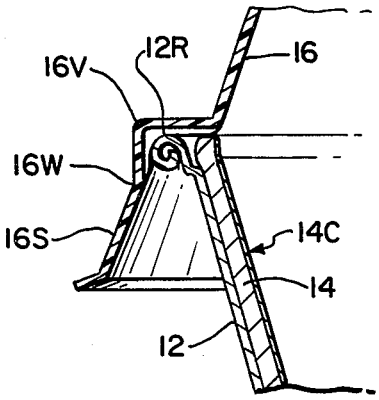
FIG. 3 is an enlarged detail taken along line 3—3 of FIG. 2.
Figure 4:
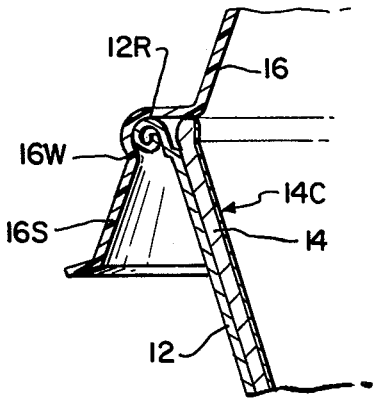
FIG. 4 is an enlarged detail taken along 4—4 of FIG. 2.

As further illustrated in FIGS. 2, 3 and 4, the skirt 16S of the domed transparent lid 16 includes equally spaced relieved portions or vents 16V which interrupt a waist line 16W within the skirt 16S, and extend upward therefrom so as to clear the upper rim portion 12R of the paper food tub 12 to provide a garter spring-like action in the skirt 16S whereby a snap fit between the lid 16 and the container 12 may be effectuated. The relieved portions 16V also serve as vent openings to permit the lid to breathe and preclude undue difficulty in removing the lid 16 from the food container 12. Portion 16R engages upper rim portion 14R of edible container 14 and maintains it in position within container 12.

Such foods as puddings, fruit fillings for tarts and the like may be placed within the edible food container 14 and moisture damage to the latter is prevented by means of the moisture barrier or coating 14C on the internal portion thereof.

This feature is particularly important in establishments such as cafeterias which prepackage food prior to the lunch hour and wish to maintain a continuity of menu, at least as to desserts, salads and the like for the dinner hour. The nature of the packaging permits chilling of an otherwise edible food container and its contents in a bed of ice without subjecting the edible portion to moisture damage. The domed lid permits viewing the contents and prevents an undue amount of exposure to the surrounding air other than by the leakage through the vent means 16V in the lid 16. A merchandising package is provided which permits maintaining desserts in an appetizing and wholesome condition for both lunch and dinner hours without requiring removal from prepackaging or reconstituting of these desserts and other food products during that time.

It should be understood that the present invention may be modified as would occur to one of ordinary skill in the art without departing from the spirit and scope of the present invention.

What is claimed:

1. A merchandising package means for temporarily storing and refrigerating a semi-liquid foodstuff in conjunction with an edible container for said foodstuff, and for displaying and serving said foodstuff and edible container, said merchandising package comprising:

an edible baked container suitable for accommodating said foodstuff, said edible baked container comprising an open top and an upper peripheral edge surrounding said open top;

a moisture barrier on at least the inner surface of said edible baked container for resisting transfer of moisture from said semi-liquid foodstuff to said baked container during temporary storage and refrigeration of said package;

an outer container shaped to conform closely to the shape of said edible baked container and containing said edible baked container in a nested configuration and formed of a moisture impervious material which is impervious to a refrigeration medium in contact with said package;

said outer container having rim means surrounding said upper peripheral edge of said edible baked container; and clear plastic lid means comprising first means engaged with said rim means for closing said package, a peripheral shoulder extending radially inwardly from said first means, said peripheral shoulder overlying and abutting said upper peripheral edge of said edible baked container for maintaining said baked container in position within said outer container, and a centrally disposed domed portion connected to said peripheral shoulder and spaced from said open top and from said upper peripheral edge of said edible baked container for preventing contact of said lid means with said semi-liquid foodstuff.

2. The merchandising package means of claim 1, wherein said outer container is comprised of paper internally coated with a moisture impervious material.

3. The merchandising package means of claim 1, wherein said first means of said clear plastic lid means comprises a dependent distortable skirt means providing a snap-on engagement with said rim means.

4. The merchandising package means of claim 3, wherein said distortable skirt means comprises a rim engaging surface for engaging said rim means and second means adjacent said rimengaging surface for permitting distortion of said skirt means and for ventilating the interior of said package.

5. The merchandising package of claim 4, wherein said second means comprises at least one surface portion of said lid means which is adjacent to and spaced from said rim means and adjacent to and spaced from said upper peripheral edge of said baked edible container.

6. The merchandising package means of claim 1, wherein said lid means includes vent means coextensive with said first means which engages said rim means and with said shoulder for venting the interior of said edible baked container.

7. A combination comprising:

an edible baked container for accommodating a foodstuff, said edible baked container comprising an open top and an upper peripheral edge surrounding said open top;

a conformally shaped outer container receiving said edible baked container in a nested configuration and comprising a material which is impervious to moisture;

said outer container having rim means surrounding said upper peripheral edge of said edible baked container; and lid means comprising first means engaged with said rim means for closing said outer container and a peripheral shoulder extending radially inwardly from said first means, said peripheral shoulder overlying and abutting said upper peripheral edge of said baked edible container for maintaining said baked container in position within said outer container;

said lid means further comprising a centrally disposed domed portion connected to said peripheral shoulder and spaced from said open top and from said upper peripheral edge of said edible baked container for preventing contact between said foodstuff and said lid means.

8. A combination as in claim 7, wherein said peripheral shoulder comprises vent means for venting the interior of said edible baked container.

9. A combination as in claim 7, wherein said peripheral shoulder further comprises vent means extending above said upper peripheral edge of said edible baked container for venting the interior of said edible baked container and said outer container.

* * * * *